United States Patent [19]

Hiroi et al.

[11] Patent Number: 4,516,929

[45] Date of Patent: May 14, 1985

[54] METHOD FOR CONTROLLING OXYGEN DENSITY IN COMBUSTION EXHAUST GAS

[75] Inventors: Kazuo Hiroi, Hachioji; Kenji Kojima, Kunitachi, both of Japan

[73] Assignee: Kabushiki Kaisha Toshiba, Kawasaki, Japan

[21] Appl. No.: 610,587

[22] Filed: May 15, 1984

[30] Foreign Application Priority Data

May 16, 1983 [JP] Japan ..... 58-85432

[51] Int. Cl.[3] ..... F23N 1/00; F23N 5/00

[52] U.S. Cl. ..... 431/12; 431/76; 236/15 E

[58] Field of Search ..... 431/12, 76; 236/15 E, 236/15 BB; 73/23

[56] References Cited

U.S. PATENT DOCUMENTS

| | | | |
|---|---|---|---|
| 4,097,218 | 6/1978 | Womack | 236/15 E X |
| 4,162,889 | 7/1979 | Shigemura | 431/76 |
| 4,396,369 | 8/1983 | Kaessmann | 236/15 E X |

*Primary Examiner*—Randall L. Green

*Attorney, Agent, or Firm*—Schwartz, Jeffery, Schwaab, Mack, Blumenthal & Koch

[57] ABSTRACT

Oxygen content in the exhaust gas of a combustion system is controlled such that the actually detected value of the oxygen content is compared with a set value which is varied in accordance with the combustion load of the system. A value theoretically adapted to control an air-fuel mixing ratio is calculated from the combustion load and the result of the comparison, and the flow rates of air and fuel supplied to the combustion system are controlled according to this value.

3 Claims, 1 Drawing Figure

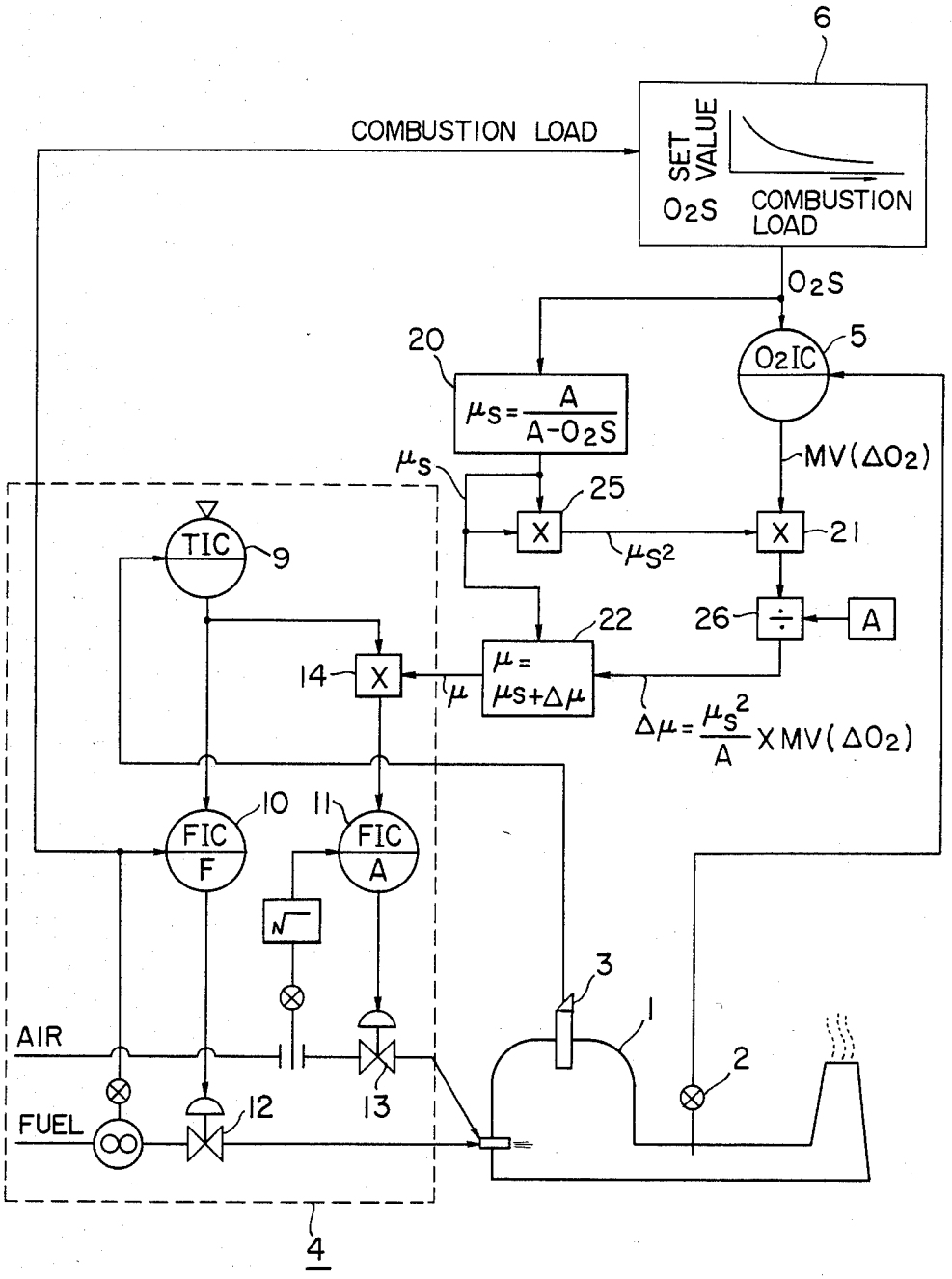
6
COMBUSTION LOAD
SET VALUE
O2S
COMBUSTION LOAD
O2S
20
O2IC
5
μs = A / A-O2S
MV(ΔO2)
μs
25
X
μs2
X
21
TIC
9
22
26
÷
A
14
X
μ
μ = μs+Δμ
Δμ = μs2 / A X MV(ΔO2)
10
11
FIC F
FIC A
3
1
AIR
2
FUEL
12
13
4

METHOD FOR CONTROLLING OXYGEN DENSITY IN COMBUSTION EXHAUST GAS

BACKGROUND OF THE INVENTION

This invention relates to a control method of oxygen density in a combustion control system, and more particularly to a method for controlling oxygen density in exhaust gas, that is created by burning fuel, in accordance with a set value which is varied by variation in the combustion load.

In an ordinary process control apparatus for a combustion furnace, fuel supplied to the furnace is burnt at a predetermined fuel-air mixing ratio, and the density of oxygen in the exhaust gas is detected by a density sensor provided in an exhaust port of the combustion furnace, while a temperature sensor is provided to detect the temperature of the furnace.

In this case, an appropriate control of the fuel-air mixing ratio is important for the combustion system in order to effect a high efficiency combustion, and when the combustion efficiency becomes low, harmful gases such as CO, $NO_x$ and dense smoke are exhausted, which gives rise to a pollution problem.

In order to ensure an optimum control of the fuel-air mixing ratio in the conventional process control apparatus, the output of the oxygen density sensor is applied to an oxygen density controller which also receives a set value delivered from an oxygen density setting device. The oxygen density controller compares the detected value of the oxygen density with the set value and delivers an output error signal which is thereafter utilized for controlling the combustion system. The oxygen density setting device presents a set value that is varied in accordance with the variation in the combustion load. On the other hand, an electric signal delivered from the temperature sensor is applied to a temperature controller provided in a combustion control apparatus.

Ordinarily, when fuel is burned in a burner of a combustion furnace, the fuel is mixed with air at a predetermined ratio. The fuel-air mixing ratio which is more accurately defined by the flow rates in weight of fuel and air is ordinarily termed an air excess ratio $\mu$. Ordinarily, the air excess ratio $\mu$ is maintained at a constant value $\mu_o$ substantially equal to 1.1.

Thus when an error is found in the above described process control apparatus between the set value and the actually detected value of the oxygen density, an oxygen density controller receiving the set value and the detected value delivers an output signal adapted to reduce the difference between the two values to zero. The output signal of the controller is converted into a correcting value $\Delta\mu$, and applied to the combustion control apparatus. In the combustion control apparatus, the air excess ratio $\mu$ is corrected in accordance with $$\mu=\mu_o=\Delta\mu \quad (1)$$

and a control operation is carried out so that the actually detected oxygen density in the exhaust gas is made equal to the set value.

The above described equation (1) can be rewritten as follows.

$$\mu=\mu_o+k(MV-x_o)/100 \quad (2)$$

wherein k is a constant, $x_o$ is a constant which is ordinarily selected to 50, and MV represents the output of the oxygen density controller which is ordinarily varied between 0 and 100.

When the correcting value $\Delta\mu$ is calculated from the output MV of the oxygen density controller as indicated in the equation (2), the combustion control apparatus controls the mixing ratio of fuel and air in accordance with the excess ratio $\mu$ defined by equation (2) and also with the output signal from the temperature controller which is provided in the apparatus for controlling the temperature in the combustion furnace.

The control method of the oxygen density in the exhaust gas is required to exhibit the following features.

(1) The oxygen density set value is not constant, but is varied in accordance with combustion load that is expressed by the flow rate of the fuel.

(2) Since the control process includes dead time of a substantial length, a sampling PI (proportional and integral) control is utilized. In this case, for the calculation of the correcting value $\Delta\mu$ of the air excess ratio $\mu$, the control frequency must be so selected that the time interval between the successive controls is made longer than the dead time, and the output of the regulator is renewed frequently.

The above described conventional control method is found to be disadvantageous in that a control error which occurs during a leisure time of the control cannot be reflected to the control of the oxygen density. Furthermore, in the conventional control method, the output of a calculator which calculates the equation (2) is a fixed value. However, in practical plants, the combustion condition varies depending on the set value of the oxygen density, and therefore the process gain of the control must be thereby varied. The conventional method lacks such a versatility of control.

SUMMARY OF THE INVENTION

An object of the present invention is to provide a method for controlling oxygen density in an exhaust gas of a combustion control system wherein the above described difficulties of the conventional method are substantially eliminated.

Another object of the invention is to provide a method for controlling oxygen density in an exhaust gas of a combustion control system, wherein the combustion in a combustion furnace is controlled at high response and fast timing such that gain control is effected in accordance with the variation of the set value, and the oxygen density in the exhaust gas can be controlled by correcting the air excess ratio in a feed forward manner according to the set value variation.

According to the present invention, there is provided a method for controlling oxygen density in the exhaust gas of a combustion system comprising the steps of detecting oxygen density in the exhaust gas, finding out a set value $O_{2s}$ based on the combustion load requirements and corresponding to the desired oxygen density in the exhaust gas, calculating an air excess ratio $\mu_s$ required for maintaining the oxygen density at the set value $O_{2s}$ by the following equation, $$\mu_s = \frac{A}{A - O_{2s}}$$

wherein A represents oxygen content in air, finding out the difference $\Delta O_2$ between the set value $O_{2s}$ and the detected value of the oxygen density in the exhaust gas, calculating a corrected value $\mu$ of the air excess ratio $\mu_s$, that is corrected against a control output $MV(\Delta O_2)$ corresponding to the difference $\Delta O_2$, according to the following equation, $$\mu = \mu_s + \frac{\mu_s^2}{A} \times MV(\Delta O_2),$$

and controlling air-fuel mixing ratio of the combustion system according to the corrected value $\mu$ so that the oxygen density in the exhaust gas is held to be equal to the set value $O_{2s}$.

BRIEF DESCRIPTION OF THE DRAWING

The accompanying single drawing is a block diagram for explaining an embodiment of the oxygen density controlling method according to the present invention.

DESCRIPTION OF THE PREFERRED EMBODIMENT

A preferred embodiment of the present invention will now be described in detail with reference to the single drawing.

Air and fuel supplied at a predetermined mixing ratio into a combustion furnace 1 through an air supplying pipe line and a fuel supplying pipe line are burned in the furnace 1, and the density of oxygen remaining in the exhaust gas is detected by an oxygen density sensor 2 which is provided near an exhaust gas delivery port. The output electric signal from the oxygen density sensor 2 representing the oxygen density in the exhaust gas is applied to an oxygen density controller 5.

On the other hand, a temperature sensor 3 is provided on the furnace 1 for detecting the temperature within the furnace 1, and the output signal from the temperature sensor 3 is applied to a temperature controller 9 provided in a combustion control system 4 hereinafter described in detail. The aforementioned oxygen density controller 5 receives as its another input a set value $O_{2s}$ set by an oxygen density setting device 6. The controller 5 compares the actually detected output of the oxygen density sensor 2 with the set value $O_{2s}$ and delivers an error or difference signal $MV(\Delta O_2)$ which is controlled thereafter into zero.

The variation $\Delta\mu$ of the air excess ratio $\mu_s$, that is the ratio of the amount of air in weight to the amount of fuel in weight, required for reducing the error $\Delta O_2$ between the actually detected oxygen density and the set value $O_{2s}$ into zero is calculated by utilizing a theoretical equation which is expressed as follows.

$$\mu_s = \frac{A}{A - O_{2s}} \tag{3}$$

wherein A represents the amount of oxygen contained in air in percentage. Ordinarily A is equal to 20.6, and frequently approximated to be 21.

Since the $\mu_s$ is varied to $\mu_s = \Delta\mu$ when the oxygen density in the exhaust gas varies to $O_{2s} = \Delta O_2$, the equation (3), with these values substituted, is given $$\mu_s + \Delta\mu = \frac{A}{A - (O_{2s} + \Delta O_2)} \tag{4}$$

From equations (3) and (4), $$\Delta\mu = (\mu_s + \Delta\mu) - \mu_s$$

-continued $$= \frac{A}{A - (O_{2s} - \Delta O_2)} - \frac{A}{A - O_{2s}}$$

$$= \frac{A \times \Delta O_2}{(A - O_{2s} - \Delta O_2)(A - O_{2s})} \tag{5}$$

Ordinarily $(A - O_{2s}) >> \Delta O_2$, and hence omitting $\Delta O_2$ from the denominator of equation (5), $$\Delta\mu \approx \frac{A \times \Delta O_2}{(A - O_{2s})(A - O_{2s})}$$

$$= \left\{\frac{A}{(A - O_{2s})}\right\}^2 \times \frac{\Delta O_2}{A}$$

$$= \frac{\mu_s^2}{A} \times \Delta O_2 \tag{6}$$

$\Delta O_2$ in equation (6) corresponds to the control error delivered from the oxygen density controller 5, and therefore, can be replaced by the output $MV(\Delta O_2)$ of the controller 5, which is a function of $\Delta O_2$ $$MV(\Delta O_2) = f(\Delta O_2) \tag{7}$$

Utilizing the relations (6) and (7), the corrected excess ratio $\mu$ can be expressed as follows.

$$\mu = \mu_s + \frac{\mu_s^2}{A} \times MV(\Delta O_2) \tag{8}$$

$$= \frac{A}{A - O_{2s}} + \frac{A}{(A - O_{2s})^2} \times MV(\Delta O_2) \tag{9}$$

As described hereinbefore, the output $MV(\Delta O_2)$ of the oxygen density controller in the conventional process control apparatus has been utilized in the combustion control in the form of equation (2), whereas according to the present invention the output $MV(\Delta O_2)$ of the oxygen density controller 5 is applied to the control in the form of the equation (8) or (9).

For comparing the control method of the present invention with the conventional control method, in consideration of a practical example, wherein the excess ratio $\mu_s$ and the set value $O_{2s}$ at the time of 100% load and 10% load are the following values $\mu_{s1} = 1.05$ and $O_{2s1} = 0.98\%$ $\mu_{s2} = 1.3$ and $O_{2s2} = 4.7\%$ respectively, and $A = 20.6$, the corrected excess ratio $\mu$ is calculated as follows:

for 100% load, $$\mu = 1.05 + 1.1 \times \frac{MV(\Delta O_2)}{20.6} \tag{10}$$

for 10% load, $$\mu = 1.3 + 1.69 \times \frac{MV(\Delta O_2)}{20.6} \tag{11}$$

While the air excess ratio $\mu$ to be used in the conventional method expressed by the equation (2) is calculated utilizing the reference value $\mu_o = 1.3$ at the time of 10% load, $$\mu = 1.3 + 1 \times MV(\Delta O_2) \tag{12}$$

Comparing the value (12) with the calculated results (10) and (11), the coefficients of $MV(\Delta O_2)$ in (10) and (11) are 1.1 for 100% load and 1.69 for 10% load respectively, while the coefficient of $MV(\Delta O_2)$ in (12) is always 1.

According to the control method of the present invention, the coefficient of the output $MV(\Delta O_2)$ is automatically varied in accordance with the variation of the combustion load, while the coefficient of the same in the conventional method is held constant regardless of the variation of the combustion load. Thus, at the time of 10% load, the gain of the combustion control according to the present invention is 1.69 times higher than that of the conventional control method.

Such an advantageous feature of the present invention can be realized by an apparatus shown in the single drawing, which is constructed to carry out the control method of the present invention. In the apparatus a calculator 20 is connected to receive the output of the oxygen density setting device 6 for calculating the excess ratio $\mu_s$ according to equation (3). Multipliers 21 and 25 are connected to receive the outputs $MV(\Delta O_2)$ and $\mu_s$ of the oxygen density controller 5 and the calculator 20, respectively, for calculating $\mu_s^2 MV(\Delta O_2)$. A divider 26 receiving the output of the multiplier 21 and the constant A calculates $\Delta\mu$ according to equation (6), while an adder 22 is connected to receive the outputs of the calculator 20 and the divider 26 for calculating the corrected value $\mu$ of the excess ratio in accordance with equation (8).

The combustion control system 4 includes a fuel flow-rate controller 10 and an air flow-rate controller 11 as well as the temperature controller 9. The temperature controller 9 delivers an output signal depending on the temperature detected by the furnace temperature sensor 3 to the fuel flow-rate controller 10 and also to the air flow-rate controller 11 for controlling the flow rates of fuel and air, respectively. More specifically, the sum of the output $\mu_s$ of the calculator 20 and the output $\Delta\mu$ of the divider 26, that is the corrected excess ratio $\mu$ is calculated in the adder 22, and the output of the adder 22 is applied to another multiplier 14 interposed between the output side of the temperature controller 9 and the air flow-rate regulator 11 for controlling the latter. The output signals from the fuel flow-rate regulator 10 and the air flow-rate regulator 11 are sent to valves 12 and 13 provided in fuel and air supplying pipes, so that fuel and air are supplied to the combustion furnace at an appropriate mixing ratio.

According to the present invention, since the variation of the oxygen density set value $O_{2s}$ is reflected in a theoretical manner to the calculation of the corrected value $\mu$ of the air excess ratio immediately, the response speed in the oxygen density control method can be substantially improved.

Furthermore, the control gain of the oxygen density can be automatically corrected in a theoretical manner as specified by equation (8) so as to stabilize the control, and the correction of the air excess ratio for the variation of the oxygen density set value can be effected immediately regardless of the leisure time of the sampling PI control in the oxygen density controller. As a consequence, even in a case where the control frequency is extremely low, a feed forward control of the oxygen density can be carried out at a fast timing regardless of the low frequency while maintaining an appropriate air excess ratio. Because of the above described advantageous feature of the invention, a stable combustion control can be executed at a low oxygen density, and an energy-economizing and pollution free control of a combustion system can be carried out while maintaining an optimum air excess ratio.

What is claimed is:

1. A method for controlling oxygen density in exhaust gas of a combustion system comprising the steps of:

detecting oxygen density in said exhaust gas;

finding out a set value $O_{2s}$ corresponding to the desired oxygen density in the exhaust gas;

calculating an air excess ratio $\mu_s$ required for maintaining the oxygen density at the set value $O_{2s}$ by the following equation, $$\mu_s = \frac{A}{A - O_{2s}}$$

wherein A represents oxygen content in air;

finding out the difference $\Delta O_2$ between said set value $O_{2s}$ and said detected value of the oxygen density in the exhaust gas;

calculating a corrected value $\mu$ of said air excess ratio $\mu_s$, that is corrected against a control output $MV(\Delta O_2)$ corresponding to said difference $\Delta O_2$, according to the following equation, $$\mu = \mu_s + \frac{\mu_s^2}{A} \times MV(\Delta O_2);$$

and controlling air-fuel mixing ratio of said combustion system according to said corrected value so that the oxygen density in the exhaust gas is held to be equal to said set value $O_{2s}$.

2. An oxygen density control method as set forth in claim 1 wherein said control output $MV(\Delta O_2)$ is obtained from an oxygen density controller which carries out sampling, and provides for proportional and integral control of the oxygen density.

3. An oxygen density control method as set forth in claim 1 wherein said set value $O_{2s}$ of the oxygen density is varied in accordance with a combustion load defined by the flow rate of fuel supplied to said combustion system.

* * * * *